United States Patent [19]

Switall

[11] Patent Number: 4,617,865

[45] Date of Patent: Oct. 21, 1986

[54] LIQUID COATER FOR A PRINTING PRESS WITH MOVEABLE INKING ROLLER AND TRAY

[75] Inventor: Thomas G. Switall, Wheeling, Ill.

[73] Assignee: Ryco Graphic Manufacturing, Inc., Wheeling, Ill.

[21] Appl. No.: 763,274

[22] Filed: Aug. 7, 1985

[51] Int. Cl.[4] ..... B41F 31/00

[52] U.S. Cl. ..... 101/350; 101/367

[58] Field of Search ..... 101/348–352, 101/375, 364, 247, 367, 207–210, DIG. 10, 148, 137, 139–140, 143–145, 182–185

[56] References Cited

U.S. PATENT DOCUMENTS

| | | | |
|---|---|---|---|
| 3,738,265 | 6/1973 | Saueressig | 101/209 |
| 3,805,700 | 4/1974 | Chambon | 101/148 |
| 4,130,057 | 12/1978 | List et al. | 101/148 |
| 4,138,944 | 2/1979 | Biggar, III | 101/247 |
| 4,214,528 | 7/1980 | Mirow | 101/352 |
| 4,231,292 | 11/1980 | Stolle | 101/137 |
| 4,290,359 | 9/1981 | Kapoor | 101/148 |
| 4,362,098 | 12/1982 | Stelling, Jr. et al. | 101/351 |
| 4,384,522 | 5/1983 | Ehlers et al. | 101/352 |

FOREIGN PATENT DOCUMENTS

| | | | |
|---|---|---|---|
| 2064431 | 6/1981 | United Kingdom | 101/352 |

*Primary Examiner*—E. H. Eickholt

*Attorney, Agent, or Firm*—Lee, Smith & Zickert

[57] ABSTRACT

The coating apparatus disclosed in this application is for a printing press having a recessed printing cylinder. The mechanism comprises a frame, a tray mounted on the frame for holding a supply of the coating material and roller means carried by the frame for transferring the liquid coating material from the tray to the printing cylinder. A pair of track members extend upwardly and rearwardly from the press and the frame is mounted on these tracks for movement toward and away from the printing press cylinder. Means is provided for moving the frame between its remote position and its position adjacent the printing press cylinder. The roller means and the tray are preferably mounted on a subframe which is pivotally mounted on the frame and means is provided for pivoting the subframe so that the roller means will move into position for engagement with the printing press cylinder after the frame has been moved into its position adjacent the cylinder. Means is also provided for positively locking the frame in its position adjacent the cylinder.

17 Claims, 9 Drawing Figures

10
12
14
16
20
22
24
26
26a
28
28a
34
36
40
48
50
52
54
56
82
84
88
90
106
108
112
118
120
122

LIQUID COATER FOR A PRINTING PRESS WITH MOVEABLE INKING ROLLER AND TRAY

BACKGROUND AND SUMMARY OF THE INVENTION

This invention relates to a liquid coater for supplying a liquid coating material to a printing press cylinder for transfer to the paper web or sheet being printed. The mechanism has particular application to a printing press having a recessed cylinder. The mechanism permits the coating rollers and tray holding the coating material to be selectively moved into and out of position for coating. When the coating rollers and tray are moved out of position they will not interfere with the printing operation or otherwise be in the way of the press operator.

It has become common practice to utilize a coater for applying a liquid coating material to the blanket of a web offset printing press so that the printed sheet or web which is moving through the press can be coated. The coating material is usually an aquaeous coating which when dry renders the printed paper resistent to moisture and oils and prevents smearing. The coaters for applying this material generally utilize a tray for holding the liquid coating material and a feed roller rotating in the liquid coating material in the tray. A coater roller is in rotating engagement with the feed roller and also in rotating engagement with the blanket cylinder of the printing press. The coating material is picked up from the tray by the feed roller, transferred to the coater roller, and retransferred to the blanket by the coater roller.

Since the coater is an adjunct to the printing press, the main function of the press being to print, the coater must be capable of being moved into and out of position with respect to the blanket cylinder. The coater may be rotrofitted onto existing presses, or it may be worked into existing press designs. In most presses, the coater can be easily added and is not in the way of the printing operation of the press. However, in a number of printing presses, the blanket cylinder is recessed so that there is very little room for the coater to be moved into position for coating the blanket cylinder. Heretofore, it has not been possible to utilize a coater with such presses because the coater would be in the way of the press operator and interfere with the normal printing operation of the press. Thus, with presses such as the "Heidelberg Speed Master", a separate coater was heretofore required.

The present invention obviates the need for a separate coater and permits the coater to be mounted on presses which have a recessed blanket cylinder. In accordance with this invention, the coater may be moved into and out of position so that it does not interfere with the printing operation of the press and it permits the printed material to be coated as it is being moved through the printing press, thus, not only saving equipment, but saving time and labor by eliminating a separate operation on a separate piece of equipment.

In accordance with one aspect of the invention, the coater mechanism for applying a liquid coating material to the recessed printing press cylinder comprises a frame, a tray mounted on the frame for holding a supply of the coating material and roller means carried by the frame for transferring the coating material from the tray to the printing press cylinder. Track means is attached to the printing press and extends from adjacent the printing press cylinder to a point remote from the printing press cylinder. The tray and roller means are preferably mounted on a subframe attached and carried by the coater frame and the coater frame in turn in mounted on the track means. Means is provided for moving the frame and the subframe with the tray and roller means carried thereon, along the track means into and out of position adjacent the printing press cylinder, and means is provided for moving the roller means into and out of position for engagement with the printing press cylinder after the coater frame has been moved to its position adjacent the cylinder. It is preferred that there be a means for locking the coater frame in its position adjacent the cylinder when it has been moved into that position. Once the frame has been moved into its position adjacent the printing press cylinder, and the subframe has been moved to position the roller means into contact engagement with the printing press cylinder, the liquid coating material may be picked up from the tray by the roller means and applied to the printing press cylinder.

In the preferred embodiment, the track means comprises a pair of rectilinear tracks which extend upwardly and rearwardly and roller means on the frame rollably engage the track means so that the frame may be moved relative to the track means toward and away from the printing press cylinder.

The frame may be moved along the track means by means of a pair of internally threaded nut members mounted for rotation adjacent opposite sides of the coater frame. Extending through the nut members and mounted in fixed position relative to the track means are a pair of spaced parallel, externally threaded rods. The drive means includes means interconnecting the nut members and for rotating them in unison selectively in a direction which will move the frame toward the press cylinder and in the opposite direction away from the press cylinder.

The subframe is preferrably pivotally mounted on the front arms of the frame so that when the frame has been moved to its lower-most position adjacent the press cylinder, the subframe may be pivoted or tilted forwardly to bring the roller means into contact with the printing press cylinder so that the coating material may be applied to the printing press cylinder.

DESCRIPTION OF THE PREFERRED EMBODIMENT

Figures 1, 4:
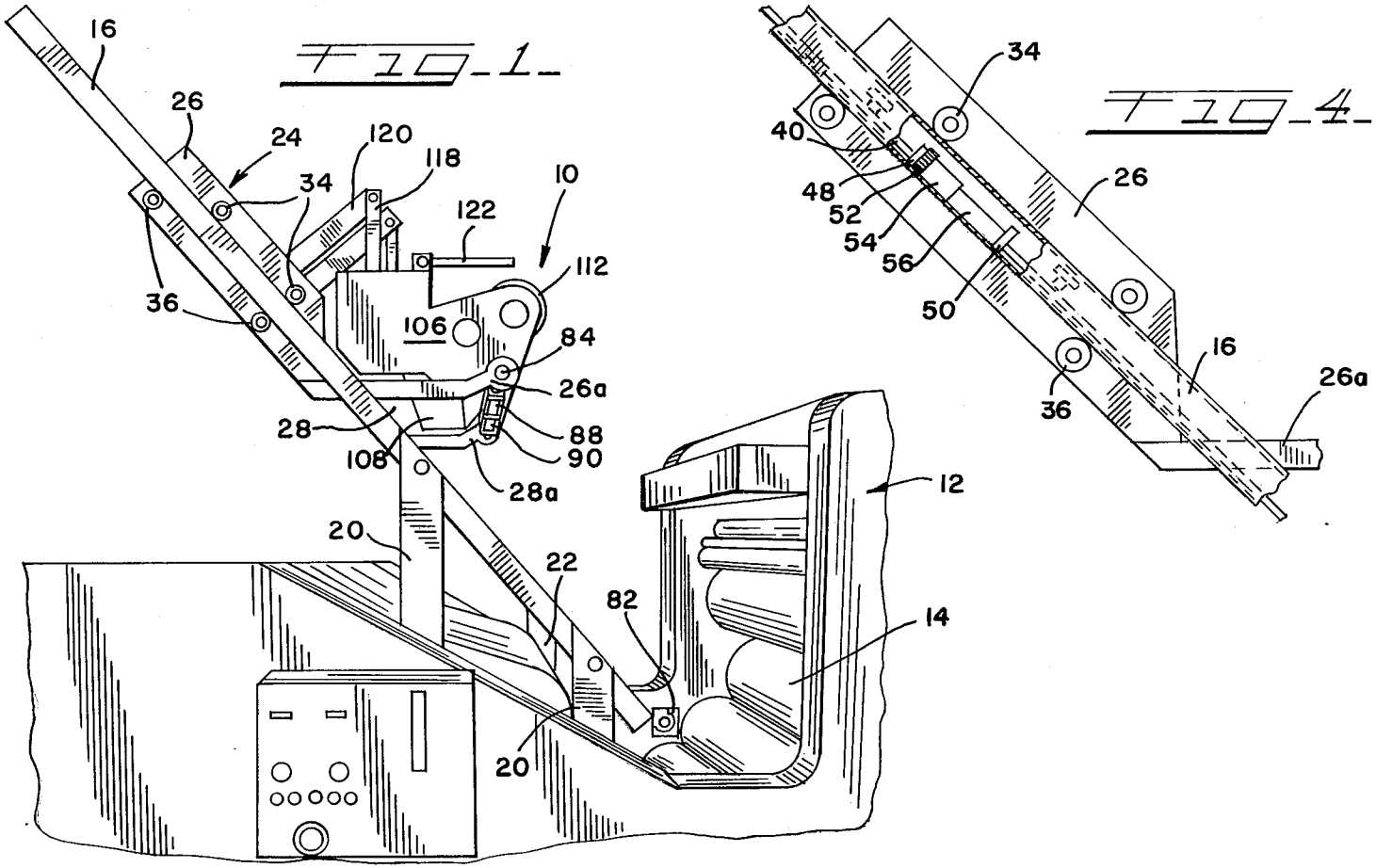
FIG. 1 is a perspective view of a coater constructed in accordance with this invention showing the coater moved out of its coating position, i.e. away from engagement with the blanket cylinder of the web offset printing press.
FIG. 4 is a side elevation view of a portions of the coater frame and track means, with part of the track means cut away to show part of the drive means for moving the frame of the coater along the track means toward and away from the printing press cylinder.

The coater 10 constructed in accordance with this invention is illustrated in FIG. 1 where it is used on a web offset press 12. The press has a blanket cylinder 14 which is normally used in the offset printing operation of the press. However, printing presses of this type have a number of different printing stages, usually one for each color, and where one of the stages or printing roller sets is not being used for printing, it has been found convenient to utilize the blanket cylinder of that otherwise unused stage of the printing press as a means for applying a coating to the web or sheet as it moving through the press. The coating material is usually an aquaeous coating which provides moisture and oil resistant matte or glossy finish to the paper and protects it from smearing.

The particular press 12 illustrated in FIG. 1 has very little room within which to apply the coating material and heretofore it has been impossible to use a coater in such a press where the blanket cylinder was recessed and other portions of the printing press prevented the coater from being moved rearwardly away from its coating position so that the blanket cylinder could be used for a printing operation as well as a coating operation.

Figures 5, 6, 7, 8, 9:
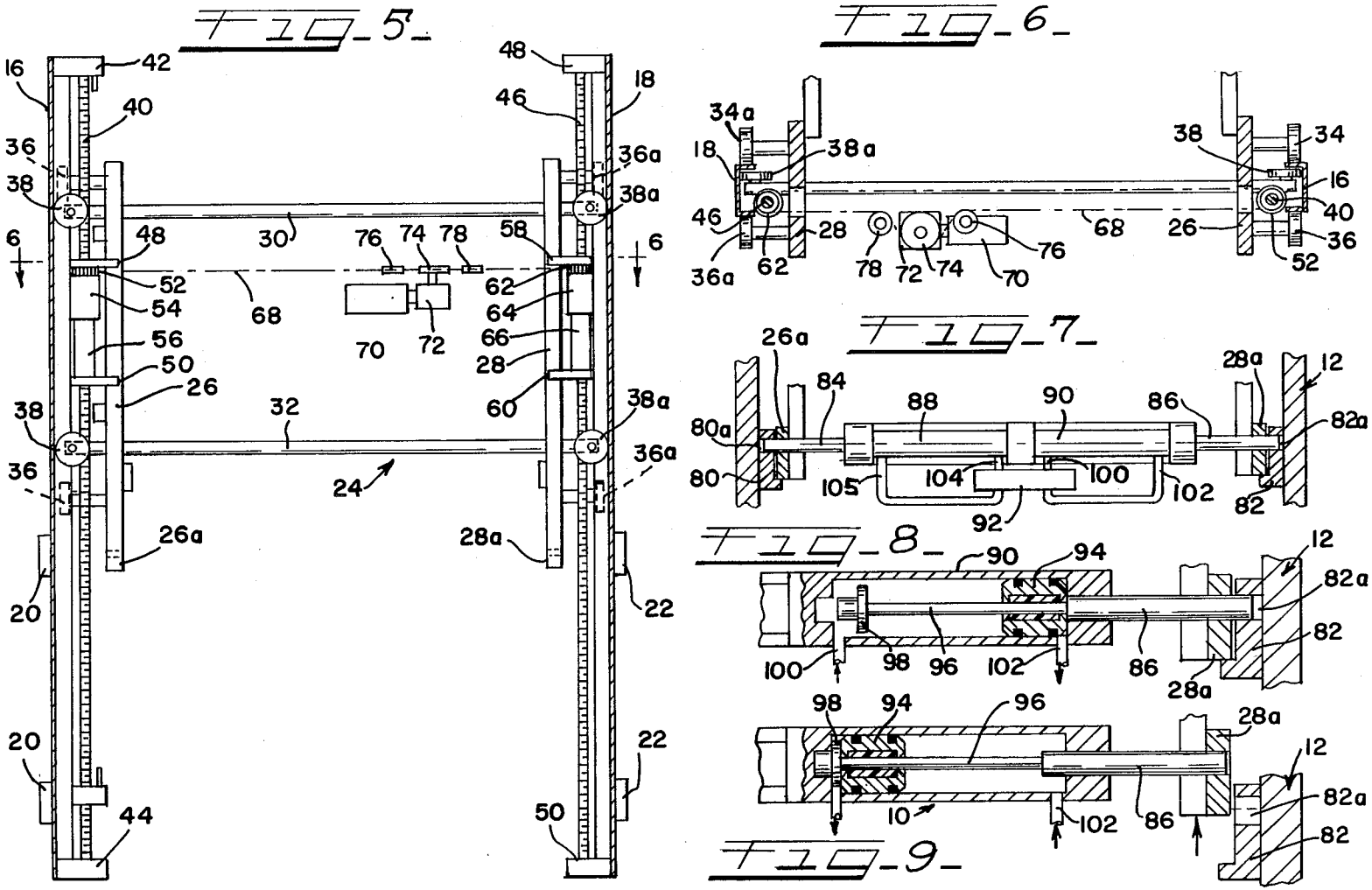
FIG. 5 is a top plan view of portions of the frame and track means with the subframe removed, showing the drive means for moving the frame along the track means.
FIG. 6 is a sectional end elevational view taken substantially the lines 6—6 of FIG. 5.
FIG. 7 is a sectional view taken across the front arms of the frame and showing the means for locking the frame into its lower-most position adjacent the press cylinder.
FIG. 8 is an enlarged end elevational view of a portion of the locking mechanism showing the mechanism in its locking position.
FIG. 9 is a view similar to FIG. 8 showing the locking mechanism after it has been moved to its unlocked position and after the frame has been moved away from its position adjacent the press cylinder.

In order to move the coater 10 into and out of position for applying the coating material to the blanket cylinder 14, a track means in the form of two channel-shaped tracks 16 and 18 are connected to the frame of the press 12 by means of supports 20 and 22, respectively (see FIG. 5). The tracks 16 and 18 extend upwardly and rearwardly at an angle of approximately 45 to 50 degrees from the horizontal. Mounted between the tracks 16 and 18 is a carriage frame 24 consisting of a pair of parallel side plates 26 and 28 and a pair of transverse bars 30 and 32 which extend between the side plates thus forming a substantially rectangular frame. The side plates 26 and 28 have arms **26*a* and 28*a* which extend forwardly and outwardly at approximately a supplementary angle with the angle of the tracks 16 and 18 so that these arms will be generally horizontal in their orientation at all times and in all positions of movement of the carriage frame 24** relative to the tracks.

Figure 2:
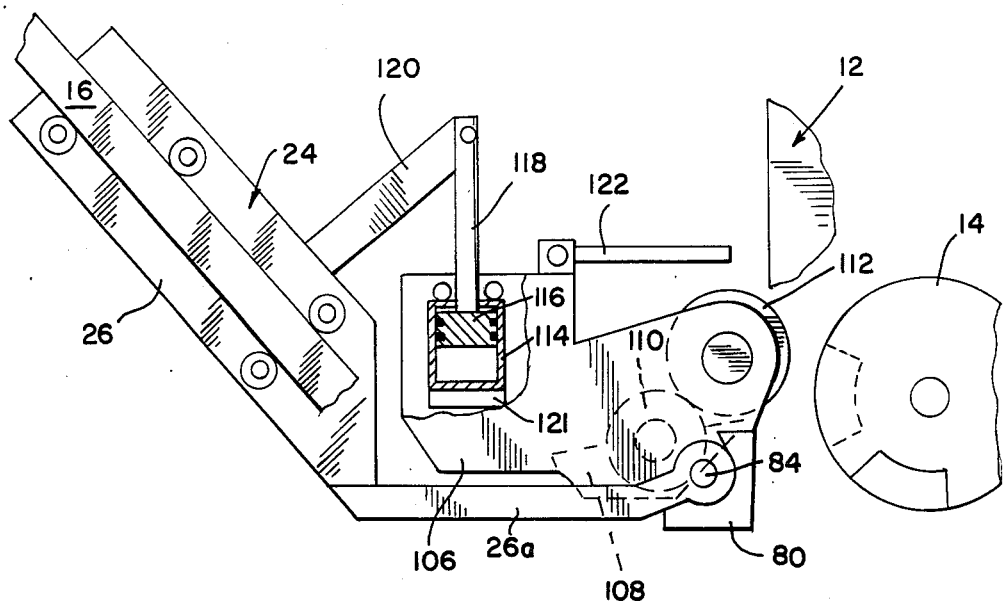
FIG. 2 is an enlarged side elevation view of portions of the press and coater schematically showing the coater after it has been moved to its coating position adjacent the printing press cylinder.
Figure 3:
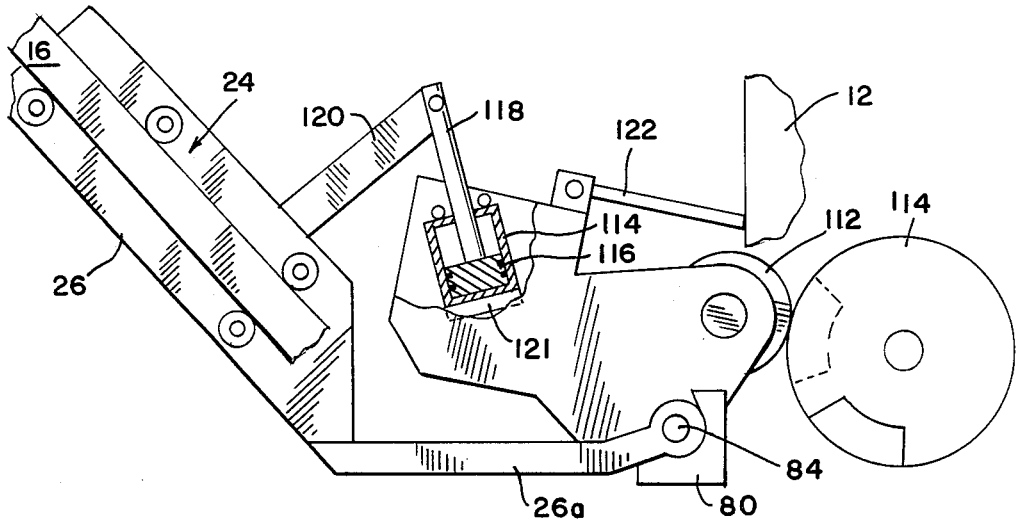
FIG. 3 is an enlarged side elevation view of the same portions of the press and coater showing the pivotal or tilting movement of the subframe to cause the coater roller to engage the surface of the printing press cylinder for the transfer of liquid coating material thereto.

The carriage frame 24 is mounted on the tracks for movement between a remote position as illustrated in FIG. 1 and a position where the coater is adjacent the blanket cylinder 14 of the printing press, schematically illustrated in FIGS. 2 and 3. For this purpose, on each of the side plates 26 and 28 there are two pairs of rollers. Roller pair 34 adjacent the top of the side plate 26 roll along the top flange of the channel-shaped track 16 and roller pair 36 located adjacent the bottom of the side plate 26 roll along the bottom flange of the track 16. This is illustrated in FIG. 1. Similar pairs of rollers **34*a* and 36*a* extend outwardly from the side plate 28 to rollably engage the top and bottom flanges, respectively, of the channel-shaped track 18. This is shown in FIGS. 5 and 6. As may also be seen in those figures, rollers 38 and 38*a*, rotating on vertical axes, engage the inside vertical surfaces of the tracks 16 and 18, respectively. Thus, the coater carriage frame 24 is able to move up and down the angular tracks 16 and 18 on the rollers 34, 36 and 38 and 34*a*, 36*a* and 38*a***, respectively.

Means is also provided for forcibly moving the carriage frame along the tracks and this is through a synchronized screw-thread drive. An externally threaded rod 40 is mounted between end mounts 42 and 44 at each end of the track 16. This rod which is a ball screw is mounted in fixed position and extends parallel to the track 16. Similarly, a ball screw 46 extends between end mounts 48 and 50 at the ends of the track 18 and this ball screw is also mounted in fixed position and extends parallel to the track 18. Extending outwardly from side plate 26 of the carriage frame are a pair of support brackets 48 and 50, and journalled for rotation between these brackets is a sprocket 52, a connector 54 and a ball nut 56. The sprocket, connector and ball nut surround the ball screw 40, and the internally threaded ball nut 56 is in threaded engagement with the threads of the ball screw 40. Similarly, on the opposite side of the carraige frame, a pair of spaced brackets 58 and 60 extend outwardly from side plate 28. Journalled for rotation between these brackets is a sprocket 62, a connector 64 and a ball nut 66, all of which surround the ball screw 46. The connectors 54 and 64 connect the sprockets 52 and 62 to their respective ball nuts 56 and 66. The sprockets 52 and 62 are operatively connected together and driven in unison by means of a sprocket chain 68. The sprocket chain in turn is driven by means of a motor 70 operating through a reduction gear box 72 and a drive sprocket 74. On either side of the drive sprocket 74 are idler sprockets 76 and 78.

Thus, the carriage frame 24 may be rolled along the tracks 16 and 18 through operation of the motor 70 which may be driven in the forward or reverse directions to drive the sprocket chain 68 and the sprockets 52 and 62. These sprockets, which are connected to the ball nuts 56 and 66, respectively, will rotate these ball nuts relative to the ball screws 40 and 46, respectively, causing the ball nut 56 to move up or down on the ball screw 40 and the ball nut 66 to move or down on the ball screw 46, thereby driving the carriage frame 24 upwardly or downwardly, depending upon the direction of operation of the motor 70.

While the ball nuts 56 and 66 may be any kind of internally threaded member to mate with the externally threaded rods 40 and 46 respectively, it is preferred that these be ball nuts and rods. The ball nuts have ball bearings arranged in an internally threaded fashion and the external threads of the ball screw 40 are adapted to mate with the ball bearings thus providing a very low friction type of connection between threse two internally and externally threaded members.

The frame 24 is adapted to be moved between an elevated and rearwardly disposed position substantially as illustrated in FIG. 1 to a lowered and forwardly disposed coating position as shown schematically in FIG. 2. In this lowered position, the rounded forward end of the arm **26*a* will seat in a positioning block 80** mounted on one side of the press frame, and the corresponding arm 28*a* of side plate 28 will seat within a correspondingly positioning block 82 mounted on the opposite side of the press frame (see FIGS. 1, 2 and 7).

Means is provided for locking the carriage frame in its lowered position adjacent the blanket cylinder of the press. This mechanism is illustrated in FIGS. 7–9. The positioning blocks 80 and 82 mounted on opposite sides of the frame of the press 12 have holes 80*a* and 82*a*, respectively, which serve as keepers for the locking pins 84 and 86. As shown in FIG. 7, when the side plate arms 26*a* and 28*a* of the carriage frame have been moved into position in seating engagement with the positioning blocks 80 and 82 respectively, the locking pins 84 and 86 will align with the respective holes 80*a* and 82*a* on the positioning blocks. In FIG. 7, the locking pins are in position within the keeper holes 80*a* and 82*b*, thus locking the carriage frame arms 26*a* and 28*a* in their lowermost position.

In order to effect locking and unlocking movements of the locking pins 84 and 86, a pair of air cylinders 88 and 90 are provided and these are controlled by means of an air valve 92. As may be seen in FIGS. 8 and 9, each of the air cylinders 88 and 90 has a moveable piston 94 which has a lost motion connection with the shank 96 of the locking pin, and at the end of the shank there is an enlarged head portion 98. The shank 96 is of substantially smaller diameter than the diameters of either the head portion 98 or the locking pins 84 and 86, and there are air ports 100 and 102 for cylinder 90 and corresponding air ports 104 and 106 for the air cylinder 88.

When the air valve 92 permits air under pressure to enter air port 100 and to exit air port 102 of the cylinder 90, the piston 94 within that cylinder will be driven to the right as illustrated in FIG. 8 and impact against the locking pin 86 to drive the pin to the right into the keeper hole 82*a* of the positioning block 82. When it is desired to unlock the arms of the carriage frame, the air valve 92 is reversed, causing air to enter air port 102 and exit air port 100. This will drive the piston 94 to the left as illustrated in FIGS. 8 and 9 to the position illustrated in FIG. 9 where it impacts the large head 98 and drives that head together with the shank 96 and the locking pin 86 to the left, thereby withdrawing the pin 86 from the keeper hole 82*a*.

The operation of the air cylinder 88 is identical and simultaneous when the air valve 92 permits air to enter air port 100 it also permits air to enter air port 104 of cylinder 88 so that both pistons of the air cylinders are driven outwardly to drive the pins 84 and 86 into their respective keepers 80*a* and 82*a* to lock the arms of the carriage frame in position. When the air valve 92 is reversed and air is permitted to enter air port 102 of the cylinder 90, it also enters air port 105 of the cylinder 88 to drive the respective pistons 94 inwardly toward one another extracting the locking pins 84 and 86 from their respective keepers thereby unlocking the arms 26*a* and 28*a* of the carriage frame.

Pivotally mounted on the locking pins 84 and 86 is a subframe 106 on which is carried a tray 108, a feed roller 110 and the coater roller 112. The liquid coating material is contained in the tray 108 and is picked up by the feed roller 110 and applied to the coater roller 112 in the usual and well known manner. The coater roller is then adapted to contact the blanket cylinder 14 to apply the coating material to the blanket cylinder.

It is important to note that the locking pins 84 and 86 form the pivotal axis of the subframe 106 and when these pins enter their respective keeper holes 80*a* and 82*a*, the pivotal axis of the subframe and of the coater roller 112 will be accurately determined and will be firmly anchored in place relative to the press 12, preventing movement of this pivotal axis during the coating operation.

When the coater frame has been moved to its lowermost position adjacent the blanket cylinder 14, and the arms 26*a* and 28*a* have been locked in their position. As previously described, the coater roller 112 will be positioned in spaced relationship with the blanket cylinder 14. In order to bring the coater roller into contact with the blanket cylinder 14, the subframe 106 is pivoted about the now firmly anchored locking pins 84 and 86 from the position illustrated in FIG. 2 to the position illustrated in FIG. 3. This pivoting or tilting movement of the subframe may be accomplished by means of an air cylinder 114 pivotally mounted on the subframe and having a moveable piston 116. An operating rod 118 is pivotally connected to a rigid upstanding arm 120 mounted on the carriage 24. The air cylinder is operated by an air valve 121 similar to valve 92, previously described in connection with the locking mechanism. When the piston 116 is moved to is elevated position illustrated in FIG. 2, the subframe is in its normal horizontal position with the coater roller 112 out of contact with the blanket cylinder 14. When the piston 116 is moved to its lower position by the controlling air valve 121, the subframe 106 will be pulled upwardly and tilted about the axis of the locking pins 84 and 86 to the position illustrated in FIG. 3 placing the coater roller in contact with the surface of the blanket cylinder 14. So that this position may be accurately determined, it is preferred that there be a rigid arm 122 which extends forwardly to engage the frame of the press 12 when the subframe 106 has been tilted to its position as illustrated in FIG. 3. In the illustrated embodiment, the air piston 114 is pivotally mounted on the subframe 106 so that when the subframe is tilted or pivoted about is axis, the air cylinder 114 may also be tilted about its axis.

The foregoing preferred embodiment has been described only by way of example and it will be appreciated that there are many modifications which can be made without departing from the spirit and scope of the invention as hereinafter claimed. For example, various other track arrangements can be employed for moving the carriage 24 up and down, and the means for forcibly moving the carriage along the tracks may also be varied. If desired, the rods 40 and 46 could be rendered moveable with the ball nuts 56 and 66 stationary. In this manner, the motor for rotating the rod 40 and 46 could be located on the track. However, this is not preferred. Various other and well known locking mechanisms could be used to lock the frame in its lowered position adjacent the blanket cylinder and various means other than that disclosed can be used to tilt the subframe into contact with the blanket cylinder.

The coater described herein solves the problem of how to provide a coater for the blanket cylinder where that blanket cylinder is recessed and where the rearward movement of the coater away from the blanket cylinder would be normally prohibited.

What is claimed is:

1. In a printing press having a recessed printing press cylinder, a coater for applying a liquid coating material to the printing press cylinder, said coater comprising a frame, a tray mounted on said frame for holding a supply of coating material, roller means carried by said frame for transferring coating material from said tray to the printing press cylinder, track means attached to the printing press and extending from adjacent said printing press cylinder to a point remote from said printing press cylinder, frame moving means for moving said frame and said tray and roller means carried thereby along a first path defined by said track means into and out of position adjacent said printing press cylinder, and tray and roller moving means for moving said roller means along a second path which differs from and intersects said first path into and out of position for engagement with the printing press cylinder after said frame has been moved to its position adjacent said cylinder, whereby liquid coating material may be picked up from said tray and applied to said printing press cylinder by said roller means.

2. The structure of claim 1 wherein said track means comprising a pair of spaced parallel rectilinear tracks.

3. The structure of claim 2 wherein said tracks extend upwardly and rearwardly from adjacent said printing press cylinder.

4. The structure of claim 2 and further including frame locking means for locking said frame in position adjacent said printing press cylinder while permitting said tray and roller moving means to move said roller means transversely into and out of position for engagement with said printing press cylinder.

5. The structure of claim 1 wherein track-engaging roller means is provided on said frame for engaging said track means whereby said frame may be rollaby moved along said track means.

6. The structure of claim 1 wherein said frame moving means comprises first threaded means on said frame, second threaded means on said track means in threaded engagement with said first threaded means, drive means for rotating one of said threaded means relative to the other, whereby said frame may be selectively moved along said track means toward and away from adjacent said printing press cylinder.

7. The structure of claim 6 wherein said first threaded means comprises at least one internally threaded nut member, and said second threaded means comprises at least one externally threaded rod member.

8. The structure of claim 7 wherein said nut member is journalled for rotation on said frame, said rod member is mounted in fixed position relative to said track means, and said drive means is operatively connected to said nut member to selectively rotate said nut member relative to said rod member.

9. The structure of claim 8 wherein said nut member is a ball nut.

10. The structure of claim 1 wherein said tray and roller moving means comprises, a subframe pivotally mounted on said frame and carrying said tray and roller means, and subframe moving means for pivotally moving said subframe between a first position wherein said roller means is out of engagement with said printing press cylinder and a second position wherein said roller means is in position for engagement with said cylinder.

11. The structure of claim 10 and further including stop means mounted on said subframe in position for engaging the printing press and stopping the pivotal movement of said subframe when said roller means has reached its position for engagement with said cylinder, whereby the coating position of said roller means may be accurately determined.

12. The structure of claim 10 wherein said subframe moving means comprises an air cylinder mounted on said frame having a moving piston operatively connected to said subframe.

13. The structure of claim 4 wherein said frame locking means comprises latch means carried on said frame, keeper means carried by said printing press and means for forcibly moving said latch means into said keeper means when said frame has been moved into a position adjacent said cylinder.

14. The structure of claim 13 wherein said means for forcibly moving said latch means includes at least one piston having a lost motion connection with said latch means, whereby said latch means may be driven by impact into and out of engagement with said keeper means.

15. The structure of claim 14 wherein said latch means includes a pair of latch pins on opposite sides of said frame, and said fluid actuated piston means comprises a pair of pistons, each having a lost motion connection with a respective one of said latch pins, and means for moving said pistons selectively in opposite directions, whereby said latch pins may be simultaneously driven by impact into and out of engagement with said keeper means.

16. In a printing press having a recessed printing press cylinder, a coater for applying a liquid coating material to the printing press cylnder, said coater comprising a frame, a subframe pivotally mounted on said frame and carrying a tray for holding a supply of coating material and roller means for transferring the coating material from said tray to the printing press cylinder, a pair of spaced tracks attached to the printing press and extending from adjacent said printing press cylinder to a point remote from said printing press cylinder, first drive means for moving said frame along said tracks toward and away from a position adjacent said printing press cylinder, means at the pivotal axis of said subframe for locking said frame in its position adjacent said printing press cylinder, whereby the pivotal axis of said subframe will be accurately fixed relative to the press, and second drive means for pivotally moving said roller means into and out of position for engagement with the printing press cylinder after said frame has been moved to and locked in its position adjacent said cylinder, whereby liquid coating material may be picked up from said tray and applied to said printing press cylinder.

17. In a printing press having a recessed printing press cylinder, a coater for applying a liquid coating material to the printing press cylinder, said coater comprising a frame, a tray mounted on said frame for holding a supply of coating material, roller means carried by said frame for transferring coating material from said tray to the printing press cylinder, track means attached to the printing press and extending from adjacent said printing press cylinder to a point remote from said printing press cylinder, frame moving means for moving said frame and said tray and roller means carried thereby along said track means into and out of position adjacent said printing press cylinder, and tray and roller moving means for moving said roller means into and out of position for engagement with the printing press cylinder after said frame has been moved to its position adjacent said cylinder, whereby liquid coating material may be picked up from said tray and applied to said printing press cylinder by said roller means, said frame moving means comprising a pair of internally threaded nut members journalled for rotation on opposite sides of said frame, a pair of spaced parallel externally threaded rods mounted in fixed position relative to said track in threaded engagement with said nut members, and drive means operatively interconnecting said nut members for rotating said nut members in unison relative to said rods selectively in one direction to move said frame along said track means toward said printing press and in the opposite direction to move said frame away from said printing press.

* * * * *